United States Patent [19]
Munson

[11] Patent Number: 4,719,470
[45] Date of Patent: Jan. 12, 1988

[54] BROADBAND PRINTED CIRCUIT ANTENNA WITH DIRECT FEED

[75] Inventor: Robert E. Munson, Boulder, Colo.

[73] Assignee: Ball Corporation, Muncie, Ind.

[21] Appl. No.: 733,612

[22] Filed: May 13, 1985

[51] Int. Cl.[4] ..... H01Q 1/38; H01Q 1/48
[52] U.S. Cl. ..... 343/700 MS; 343/829; 343/834; 343/835; 343/848
[58] Field of Search ..... 343/700 MS, 767–771, 343/708, 829, 846, 854, 817–819, 834–837, 893, 848; 333/238, 246

[56] References Cited

U.S. PATENT DOCUMENTS

| | | | |
|---|---|---|---|
| 2,885,676 | 5/1959 | Baldwin | 343/769 X |
| 3,757,342 | 9/1973 | Jasik et al. . | |
| 4,035,807 | 7/1977 | Tang et al. | 343/742 |
| 4,054,874 | 10/1977 | Oltman, Jr. | 343/700 MS |
| 4,063,246 | 12/1977 | Greiser | 343/846 X |
| 4,131,894 | 12/1978 | Schiavone | 343/700 MS |
| 4,155,089 | 5/1979 | Kaloi | 343/700 MS |
| 4,170,013 | 10/1979 | Black | 343/700 MS |
| 4,173,019 | 10/1979 | Williams | 343/700 MS |
| 4,197,544 | 4/1980 | Kaloi | 343/700 MS |
| 4,197,545 | 4/1980 | Favaloro et al. | 343/700 MS |
| 4,291,311 | 9/1981 | Kaloi | 343/700 MS |
| 4,291,312 | 9/1981 | Kaloi | 343/700 MS |
| 4,486,758 | 12/1984 | deRonde | 343/700 MS |

*Primary Examiner*—Marvin L. Nussbaum
*Attorney, Agent, or Firm*—Gilbert E. Alberding

[57] ABSTRACT

A relatively broadband printed circuit antenna structure includes a dielectric sheet having printed circuit-like conductive structures printed on both sides in predetermined registration with one another. A traditional non-radiating microstrip transmission line structure extends from a common r.f. feedpoint to at least one terminal end portion. However, apertures disposed within the underlying (or overlying) conductive reference surface of the double-cladded printed circuit board in the vicinity of each terminal end cause substantial r.f. radiation to occur over a relatively broader bandwidth than with a more traditional microstrip antenna radiator structure. In one embodiment, the aperture in the microstrip ground plane itself becomes a radiating aperture due to the transmission line currents flowing within the ground plane. In other embodiments, the terminal end portion of the microstrip transmission line becomes a monopole radiator when it is encompassed by an aperture or opening in the pattern of the printed ground plane. A conductive reflector surface may also be disposed about one-fourth wavelength behind the printed ground plane—unless radiation directed away from either side of the antenna structure is desired.

24 Claims, 14 Drawing Figures

FIG. 1
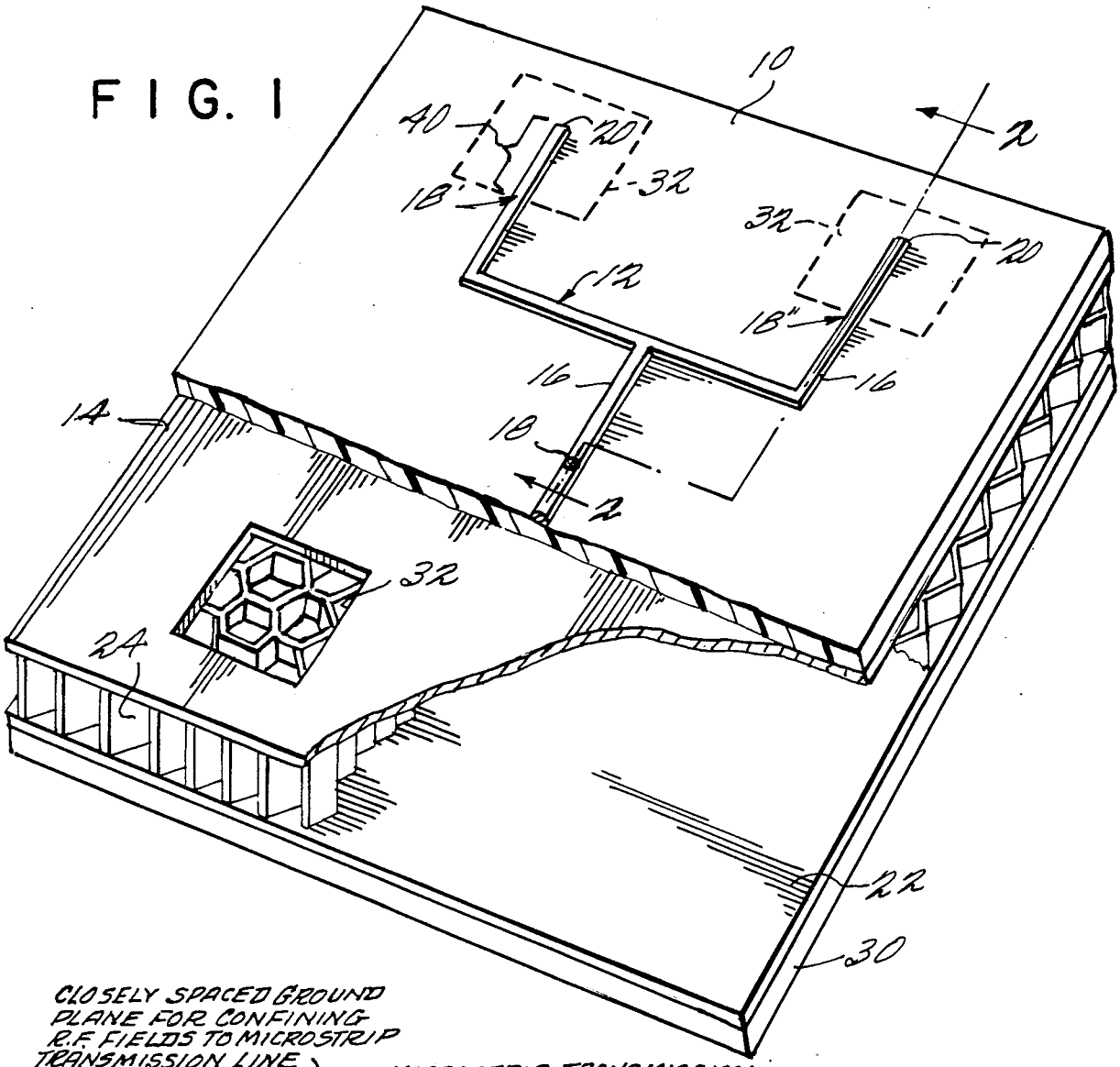
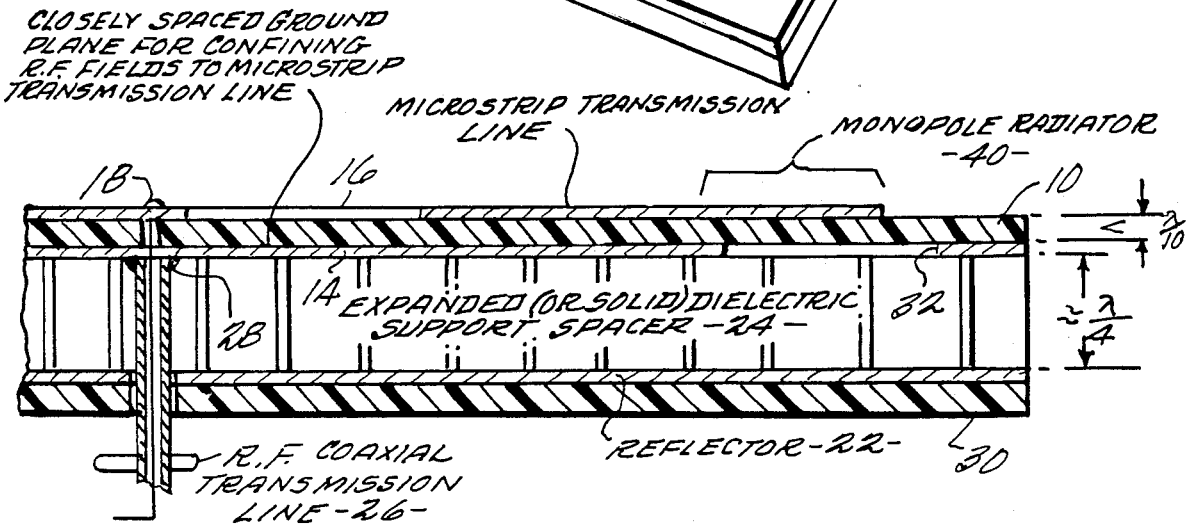
FIG. 2

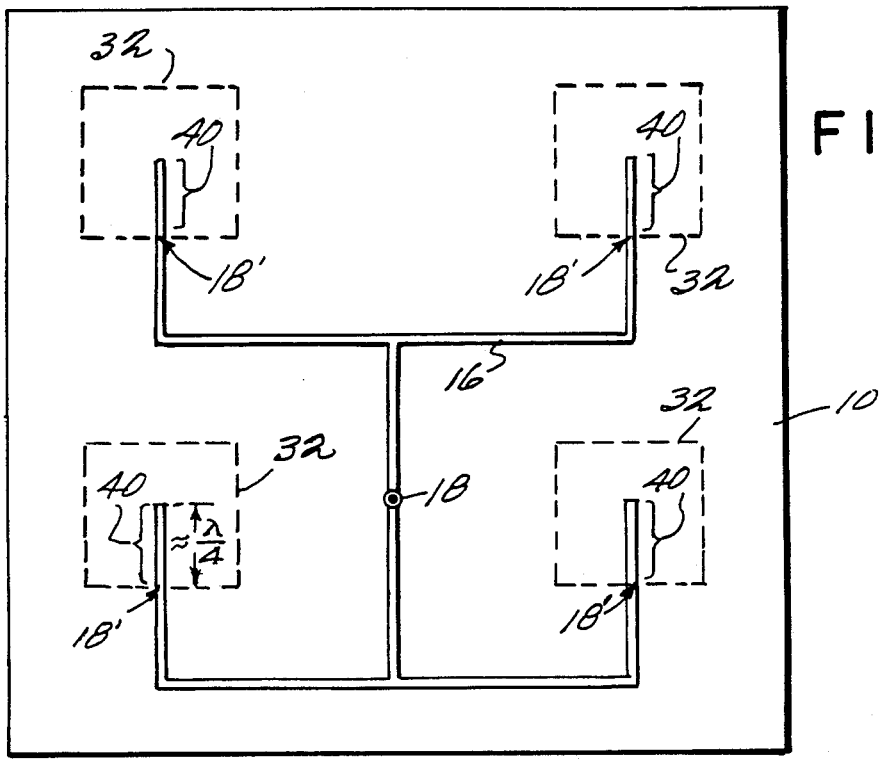
FIG. 3A
FIG. 4A
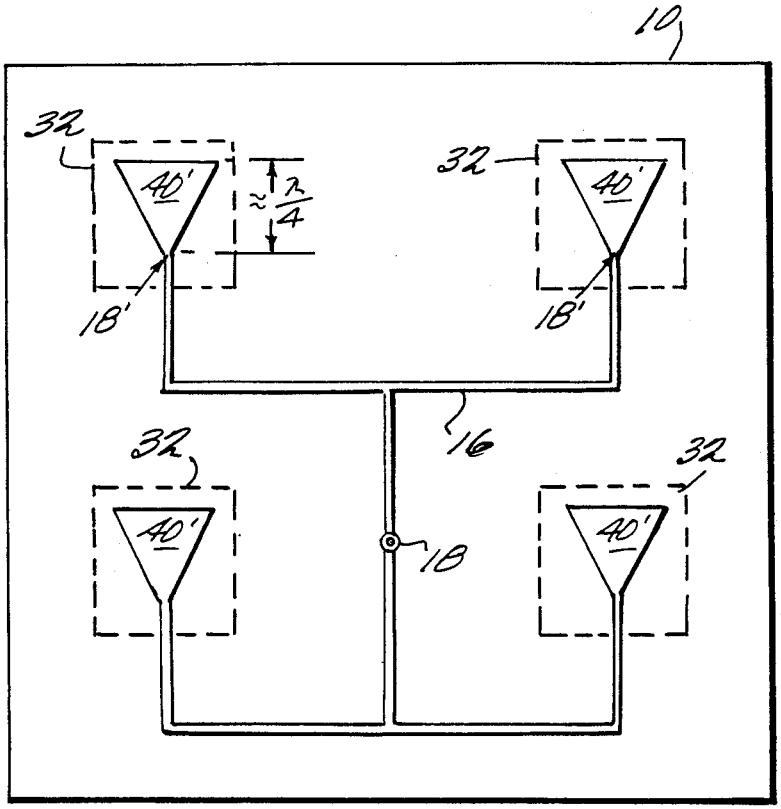

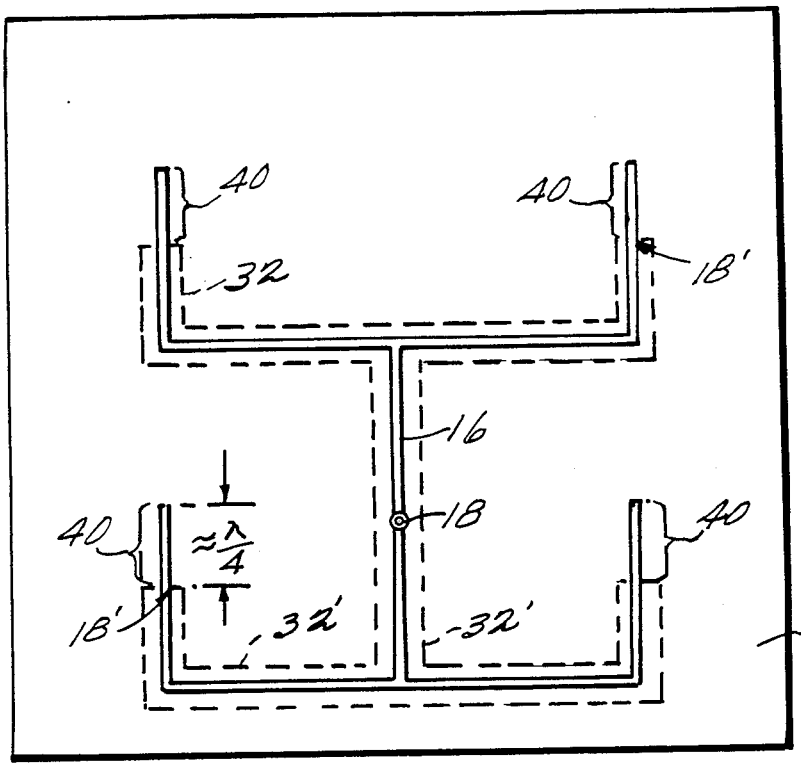
FIG. 3B
FIG. 4B
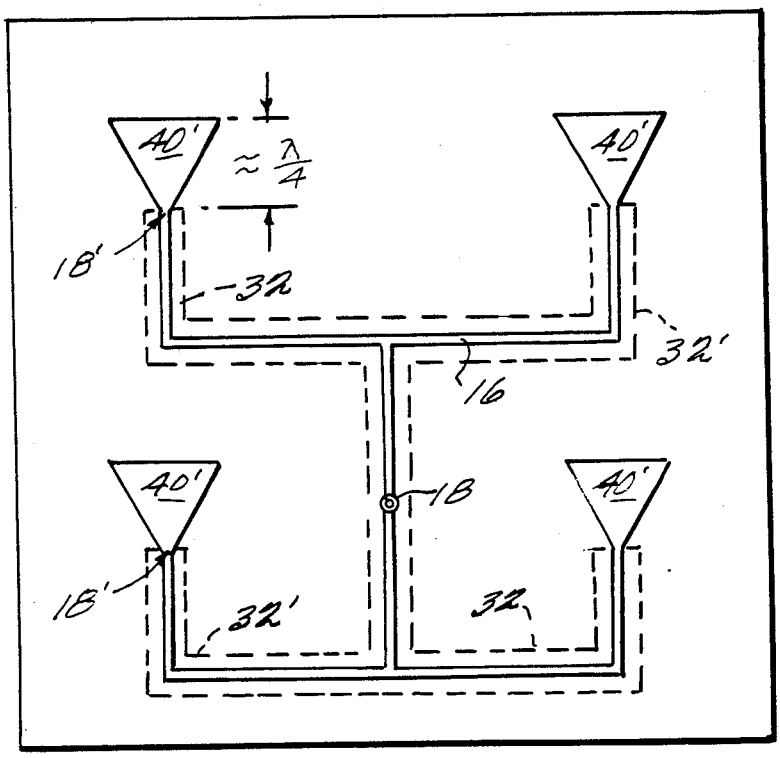

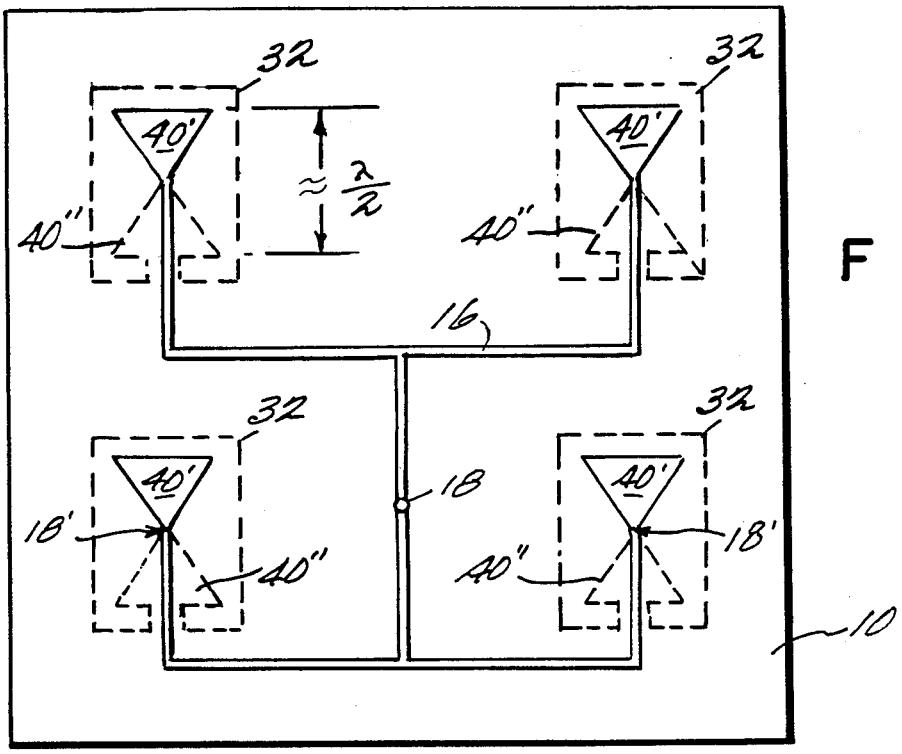
FIG. 5A
FIG. 6B
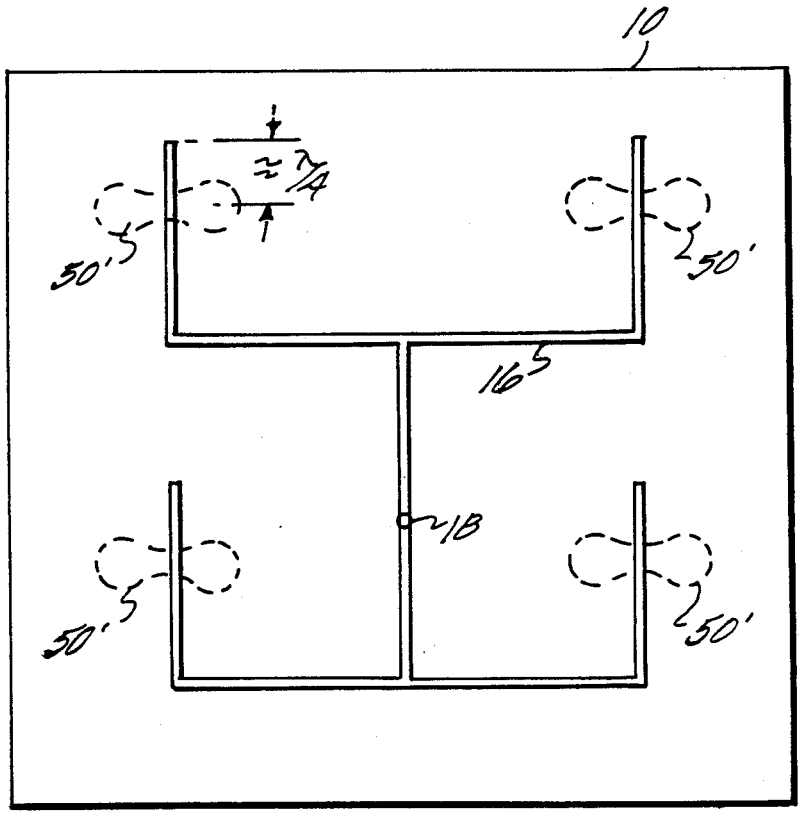

BROADBAND PRINTED CIRCUIT ANTENNA WITH DIRECT FEED

This invention generally relates to microwave antenna structures of the "printed circuit" type employing microstrip transmission line. It is believed particularly suited to reliable manufacture of antennas having relatively efficient broadband operation at relatively high microwave frequencies.

Microstrip antenna systems employing resonant dimensioned conductive areas (disposed less than about one-tenth wavelength from an underlying ground or reference surface) are well known in the prior art. However, there are typically several competing design restraints imposed upon such systems. For example, to minimize unwanted r.f. radiation from the r.f. microstrip transmission line (i.e. feedlines) portion of the structure, it is desired to keep those transmission lines as close as possible to their electrical reference or "ground" surface (e.g. less than about one hundredth wavelength or so). On the other hand, the typical r.f. microstrip radiator "patch " has a relatively narrow bandwidth (e.g. 2% or so) and a corresponding high Q-factor when it is maintained at such extremely close spacing to the underlying ground plane. Accordingly, so as to obtain more broadbanded response from the radiator "patch" it is often necessary to raise the patch somewhat from the underlying ground plane (even though it is typically still less than about one-tenth wavelength in total separation distance). As will be understood, these two considerations therefore become competing design criteria where broadband antenna radiation characteristics are desired.

The general problem has been recognized before and one form of prior attempted solution has been to consider non-conductively coupled microstrip transmission line structures. For example, a commonly assigned U.S. Pat. No. 4,477,813—Weiss proposes a microstrip antenna system having non-conductively coupled microstrip feedline such that the feedline structure can be disposed near a ground plane structure and yet non-conductively coupled to a more remotely located r.f. radiator "patch" structure. Reference should be made to this Weiss patent and to the many prior art references cited therein for a more general understanding of some prior art techniques.

However, prior non-conductively coupled approaches of the type proposed by Weiss typically require the separate formation of printed circuit patterns on different dielectric sheets which must then be correctly registered with one another. At the higher r.f. frequencies where wavelengths are quite short, and especially where large numbers of individual radiators and feedlines in an overall array are involved, the magnitude of the mechanical problem presented to successfully manufacture such devices with accurate registration between two separately produced printed circuit board structures can become overwhelming.

Accordingly, I have now conceived what I believe to be a new type of relatively broadband printed circuit antenna structure having direct feed and where two registered printed circuit layers may be more conveniently and accurately formed on opposite sides of a doubly-cladded dielectric sheet. Furthermore, the particular structure now conceived may even have somewhat less severe registration requirements between the two printed patterns on opposite sides of the dielectric sheet thus further simplifying the mechanical construction problems.

The now conceived exemplary embodiments of this invention include a doubly-cladded doubly-printed dielectric sheet disposed about one-fourth wavelength above a reflective conductive sheet (spacings from 1/10 to almost ½ wavelength may possibly sometimes be used). A microstrip feedline emanates from a common r.f. input/output to one or more terminal ends on one side of the dielectric sheet while strategically located apertures appear in the vicinity of the terminal end portions on the other side of the dielectric sheet. Indeed, the apertures, in some embodiments, may be expanded so as to leave only sufficient printed reference or ground plane surface to keep the microstrip transmission lines functioning in their intended non-radiating mode (e.g., a strip about 3 times wider than the line itself although merely equal width strip may sometimes suffice). In some embodiments the terminal end portions of the microstrip transmission line (totally exposed beyond the edges of the underlying ground plane) act as monopole radiators while, in other embodiments, the transmission line currents already flowing in the ground plane structure are interrupted by a transverse radiating aperture in the ground plane structure itself. In still other embodiments, a shaped ground plane structure cooperates with a monopole radiator thereabove to collectively provide a dipole radiator.

There may be a considerable number of prior art references generally relevant to individual ones of these features. For example, a nonlimiting exemplary listing of some such references is set forth below:

U.S. Pat. No. 3,757,342—Jasik et al (1973)
U.S. Pat. No. 4,035,807—Tang et al (1977)
U.S. Pat. No. 4,054,874—Oltman, Jr. (1977)
U.S. Pat. No. 4,131,894—Schiavone (1978)
U.S. Pat. No. 4,170,013—Black (1979)
U.S. Pat. No. 4,173,019—Williams (1979)
U.S. Pat. No. 4,197,544—Kaloi (1980)
U.S. Pat. No. 4,197,545—Favaloro et al (1980)
U.S. Pat. No. 4,291,311—Kaloi (1981)
U.S. Pat. No. 4,291,312—Kaloi (1981)

Of these exemplary references, Jasik et al may be considered quite relevant for their teaching of a doubly-cladded, doubly-printed antenna structure disposed about one-fourth wavelength above a reflective ground plane. However, a study of Jasik et al reveals that radiation is achieved from between the edges of alternating widened areas in the microstrip transmission line structures and that, in actuality, the operation as well as structure of the Jasik et al antenna is really considerably different from the invention now being described. Tang et al may also be considered quite relevant for their teaching of an integrated microstrip phase shifter circuit coupled to a slot radiator in its ground plane by a pin connector passing through a dielectric substrate. However the Tang et al radiator is still said to be fairly narrow band (e.g. a 5% to 10% bandwidth). Furthermore the shorting feed pin in the Tang et al structure is an added manufacturing difficulty.

Oltman, Jr. and Williams are exemplary of microstrip-dipole or other forms of radiator structures per se. And, of course, a monopole radiator and/or a slot type radiator structure is per se also well known in the art.

The Schiavone, Black, Kaloi and Favaloro et al references are all exemplary of various microstrip antenna structures having apertured ground planes (typically an apertured overlying ground plane). Favaloro et al also includes a radiating slot aperture formed in an overlying ground plane structure.

In brief summary, my new antenna structure includes a dielectric sheet having top and bottom surfaces and a thickness of less than about one-tenth wavelength at the intended antenna operating frequency. Typically, the thickness may be even less than one one-hundredth of a wavelength. Since significantly broadbanded antenna operation is intended (e.g. perhaps as much as 50% or more bandwidth), the dimensions given herein with respect to the intended antenna operating frequency may be considered to be taken at the mean intended antenna operating frequency.

The dielectric sheet has both a top and a bottom photo-chemically etched conductive structure. Typically, the dielectric sheet may be of a conventional commercially available Telfon-fiberglas material (e.g. one 32nd inch thick) cladded on both sides with a thin (e.g. 0.001 inch) copper layer which is then photo-chemically etched in accordance with desired patterns using techniques that are well known in the art (e.g. for the production of printed circuit boards and the like).

The top conductive structure, in the exemplary embodiments, comprises a microstrip feedline extending from a common r.f. input/output feedpoint to at least one terminal end (and typically in a corporate structure to an array of plural such terminal ends). The bottom conductive structure, in the exemplary embodiments, comprises a reference surface disposed by the dielectric sheet thickness below the microstrip line. Either of the printed conductive structures may be on "top" or on the "bottom" since the three layered radiating structure radiates equally to either side of the generally planar structure. Accordingly, as will now be appreciated, the words "top" and "bottom" are used herein purely for convenience in attaching relative directional descriptors to the structure.

The ground or reference plane structure is "opened" in the vicinity of each terminal end of the microstrip transmission line. In some embodiments, the opening itself becomes a radiating aperture within the ground plane (e.g. by interrupting the normal flow of ground plane currents associated with the microstrip transmission line). In other embodiments, the opening serves to expose a monopole radiator at the terminal end such that it is no longer extremely close to the reference or ground plane surface. Accordingly, the monopole becomes a radiator. In other embodiments, a portion of the printed ground plane is shaped in complementary symmetry to that of a monopole at the terminal end so that this portion of the ground plane also serves as a radiator which then collectively provides a dipole radiator structure.

Since radiation from either the monopole or from the radiating ground plane structures will be directed to both sides of the generally planar three layered structure, many applications will include a reflective conductive surface disposed on one side about one-fourth wavelength therefrom. Alternatively, if radiated power considerations are of less concern than is broadbandedness of operation, then an r.f. absorbant material might be disposed on that one side of the antenna structure.

In the monopole/dipole radiator embodiments, the opening(s) in the microstrip ground plane may actually be extended so far as to eliminate all of the printed conductive ground plane structure except for a strip portion underlying the microstrip line itself as required to effectively confine the r.f. fields thereto. For example, the underlying reference or ground plane structure might simply be a strip following the microstrip line and having a width approximately three times or so the width of the microstrip line itself. Of course, the underlying ground plane "strip" would terminate short of the monopole radiator structure at each terminal end since that portion is desired to radiate r.f. energy.

In the ground plane radiating slot embodiments, the slot may be of generally rectangular shape (e.g. about one-half wavelength long in some embodiments or, in others, somewhere between about 1/10 wavelength to a substantially continuous slot i.e. a length substantially more than one-half or perhaps even more than one wavelength) and of varying width so as to extend the bandwidth over which effective radiation occurs.

In the embodiments which include a quarter wavelength reflective cavity, the cavity may be filled with expanded or solid dielectric material which may, for example, also substantially mechanically support the dielectric sheet and its top and bottom conductive structures.

In the monopole radiator embodiments, a shaped portion of the underlying ground or reference plane structure may extend in complementary symmetry away from the monopole radiator so as to, in effect, collectively constitute a dipole radiator structure. The ground plane half of the dipole radiates due to the normal transmission line currents already flowing in the ground plane. In such "dipole" embodiments, the shaped portion of the ground plane and the monopole radiating structure itself are typically of diverging widths so as to better accommodate a broadband of radio frequencies.

Although the exemplary embodiments depicted in the drawings have only four radiating elements in each array, it will be understood that the principle can be utilized with one, two or any number of radiating elements. Typically, a corporate-structured microstrip transmission line is used to feed r.f. signals to/from a common r.f. connection (e.g. to a coaxial cable or the like) and the radiating elements of the array.

These as well as other advantages and objects of this invention will be better understood and appreciated by reading the following detailed description of the presently preferred exemplary embodiments in conjunction with the accompanying drawings, of which:

FIG. 1 is a cut-away perspective view of a first exemplary embodiment of this invention involving monopole radiators;

FIG. 2 is a cross-sectional view of the embodiment shown in FIG. 1;

FIG. 3A is a schematic plan view of the embodiment depicted in FIGS. 1 and 2;

FIG. 3B is a schematic plan view of an alternate to the FIG. 3A embodiment wherein the ground plane apertures have been opened to a greater extent;

FIG. 4A is a schematic plan view of another alternate to the FIG. 3A embodiment where the monpole radiators are of diverging width to increase their broadbandedness;

FIG. 4B is a schematic plan view of an alternate to the FIG. 4A embodiment where the apertures in the ground plane have been opened to a greater extent;

FIG. 5A is an alternate embodiment to that of FIG. 4A wherein a shaped portion of the ground plane extends in complementary symmetry to the monopole radiator so as to produce, in effect, in a composite, a dipole radiator;

FIG. 6B is an alternate embodiment to that of FIG. 6A wherein the width dimension of the radiating ground plane aperture is varied so as to increase its broadbandedness;

Figure 5B:
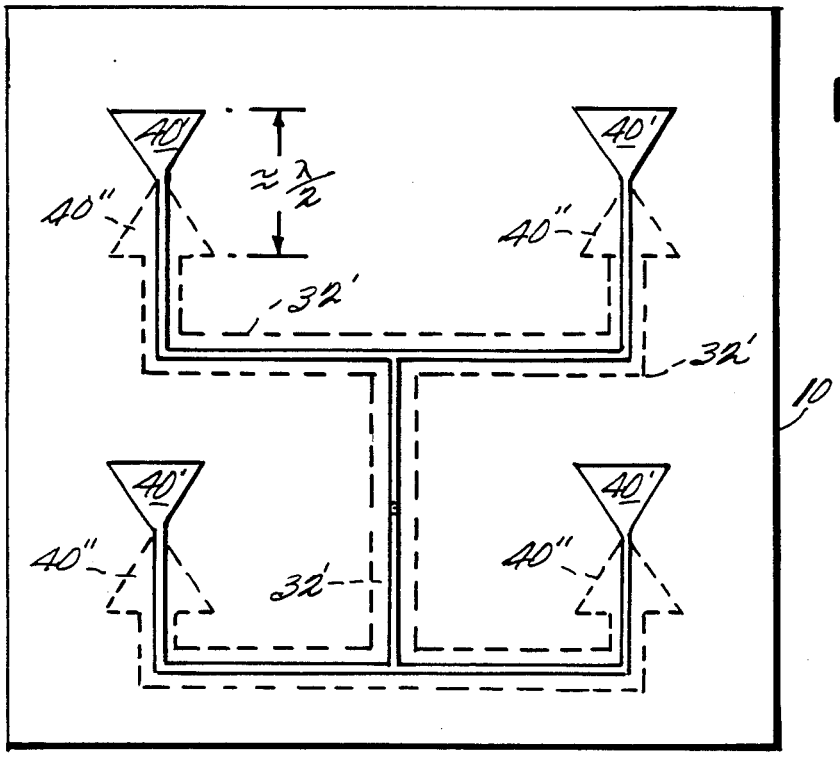
FIG. 5B is an alternate embodiment to that of FIG. 5A wherein the ground plane structure apertures have been extended to a greater extent.

Since the multi-layered construction is generally the same for all embodiments, it has been shown in detail at FIGS. 1 and 2 only for the embodiment of FIG. 3A. Accordingly, the following general comments concerning the multi-layered construction will generally apply to all embodiments.

The essential top three layers comprise a dielectric sheet 10 having photo-chemically etched conductive structure 12 on one side and photochemically etched conductive structure 14 on its other side. Typically, the dielectric sheet 10 may be about 0.031 inch thick Teflon/fiberglas (relative dielectric constant of about 2.45) cladded on both sides with a thin copper sheet (e.g. 0.001 inch thick) that is selectively etched using conventional photo-chemical processes to form desired shaped conductive surfaces 12 and 14. In the S-band, for example, the 0.031 inch thick dielectric sheet 10 would represent about 0.014 wavelength.

Layer 12 (which happens to be topmost in the exemplary embodiments but which can just as well be bottommost) includes a microstrip transmission line 16 emanating from a common r.f. input/output feedpoint 18 to one or more terminal ends 20. As will be appreciated by those in the art, where the line structure 16 overlies a relatively wide expanse of closely spaced reference surface 14, its r.f. fields will be tightly bound to the line structure (especially where the thickness of the substrate is minimized) which will then serve as a conventional non-radiating microstrip transmission line.

Unless radiation patterns directed away/toward both sides of the dielectric sheet 10 are desired, then a reflective conductive surface 22 may be provided at about one-fourth wavelength under the dielectric sheet 10. Typically the resulting quarter-wavelength reflective cavity is filled with an expanded (or solid such as Teflon-fiberglass) dielectric support/spacer structure 24. Such a spacer may be of honeycombed structure (as illustrated) or of expanded foam, solid Teflon/fiberglass, air (assuming other suitable mechanical support at spaced locations), etc.

An input/output r.f. coaxial transmission line or the like 26 may extend upwardly through the quarter wavelength reflective cavity where its outer shield may be soldered or otherwise connected (as at 28) to the shaped reference or ground plane surface 14 while the center conductor of the coaxial cable extends through to a soldered or other conductive connection at the input-/output feedpoint 18 of the microstrip transmission line 16. The coaxial cable 26 may also be soldered to the reflective layer 22 at its point of passage therethrough. However, such connection is not believed absolutely necessary and, in some cases, it may be undesirable as will be appreciated by those in the art. It will be noted that the entirety of conductive structures 12 and 14 are in direct electrical connection to one respectively corresponding conductor of the two conductor r.f. transmission lines 26. Boundaries of the shaped conductive surface 14 (e.g. aperture edges 32 in FIG. 1) are indicated schematically by dotted lines when viewed in plan through the dielectric layer 10.

As illustrated in FIGS. 1 and 2, the reflective surface 22 may also comprise a copper clad dielectric sheet 30, if desired.

In its simplest embodiment, the antenna of this invention comprises a three layer device comprising a dielectric sheet 10 and shaped conductive layers 12 and 14 cladded to either side of the dielectric sheet. The shaped/printed conductor 12 comprises a microstrip transmission line in conjunction with the shaped/printed ground or reference plane conductor 14 which is, in turn, apertured or otherwise "opened" so as to permit relatively broadbanded coupling to r.f. fields either through a radiation slot in the ground plane itself or through exposed monopole/dipole radiator structures. At the same time, the desired non-radiating microstrip transmission line structure is maintained closely spaced to its r.f. reference or ground plane structure. Where radiation in only a single half-space direction from the dielectric sheet 10 is desired, then additional structure is added to the other side of the dielectric sheet. In particular, the exemplary embodiments show a quarter-wavelength reflective cavity. However, since the impedance of the reflective cavity transformed to the radiation structure will necessarily interact with it so as to possibly somewhat restrict its broadbanded nature, there may be some applications in which broadbandedness is sufficiently more important than radiated power efficiencies so as to make it advisable to use an r.f. absorbent structure in lieu of the quarter wavelength reflective cavity.

As shown schematically in FIG. 3A, the embodiment depicted at FIGS. 1 and 2 includes a quarter-wavelength monopole radiator 40 due to the fact that approximately one-fourth wavelength at the terminal end of each of the microstrip transmission lines is left "exposed" by the underlying aperture 32 in the ground plane structure. The embodiment of FIG. 3B should operate substantially the same as the embodiment of FIG. 3A since all but the terminal one-fourth wavelength end of each microstrip transmission line is effectively prevented from radiating by relatively wider ground plane layer pattern 14 defined by the edges 32'. Typically, for effectively preventing too much r.f. radiation, the ground plane strip underlying (or overlying) the microstrip transmission line 16 is approximately three or more times as wide as the microstrip transmission line itself (which may typically be on the order of one-fifteenth wavelength or so).

The shaped microstrip transmission line actually comprises shaped conductive structures 12 and 14 cladded to the two surfaces of dielectric sheet 10. The conductive microstrip lines 16 of a first predetermined width are disposed on one side of the dielectric sheet and extend away from a single in/out feedpoint 18 to radiator feedpoints 18'. The conductive reference structure 14 is disposed on the other side of the dielectric sheet 10 and it extends substantially beyond the projected edge boundaries of the conductive microstrip line 16 so as to define a non-radiating microstrip transmission line. The monopole radiators 40 are each integrally formed with and connected to each of the radiator feedpoints 18' as an extended part of the conductive microstrip line 16 and the monopole radiators extend beyond the projected edge boundaries of the conductive reference structure by approximately one-fourth wavelength.

The embodiment of FIG. 4A also is intended to operate quite similarly to that of the FIGS. 3A, 3B embodiments. However, as shown in FIG. 4A, the monopole radiator 40' now has diverging width so as to better accommodate a broader band of r.f. frequencies. And the embodiment of FIG. 4B is substantially similar to that of FIG. 4A and directly analogous to that of FIG. 3B previously discussed with respect to the embodiment of FIG. 3A. In essence, the apertures 32 have again been "opened" to a greater extent such that their edges coincide on boundaries 32' to comprise the minimum required underlying ground plane structure 14 to sufficiently confine r.f. fields to the microstrip transmission line 14 except for the "exposed" monopole radiators.

The embodiment of FIG. 5A is quite similar to that of FIG. 4A, for example, except that the boundaries of the shaped r.f. ground plane layer 14 now also include a monopole radiating element 40" which is of complementary symmetry to the monopole radiator 40' (which radiator 40' is integrally formed thereabove with the microstrip transmission line 16). Due to the r.f. currents normally flowing in the ground plane anyway, this shaped segment 40" of the ground plane will itself become a radiator and the composite effect is a "dipole" radiator within a somewhat elongated aperture 32 so as to accommodate the approximately half wavelength overall radiating structure. Once again, the embodiment of FIG. 5B is quite similar to that of FIG. 5A except that the openings 32 have been extended to the maximum amount so as to leave only the minimum required underlying ground plane structure 14 required to keep the r.f. fields confined to the microstrip transmission line—except in the area where radiation is desired.

Figure 6A:
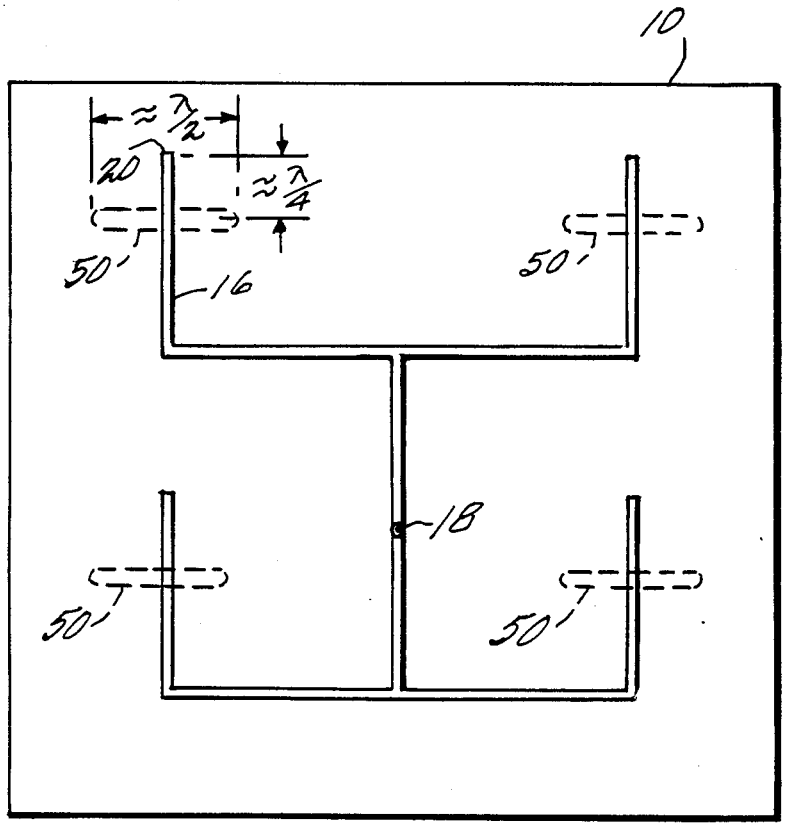
FIG. 6A is an alternate embodiment to that of FIG. 3A wherein radiating rectangular apertures are provided within the ground plane in lieu of the exposed monopole radiators.

In the embodiment of FIG. 6A, the transmission lines currents normally flowing in the ground plane are interrupted by a generally rectangular slot 50 which is disposed transverse to the microstrip transmission line 16 in the general vicinity of each terminal end portion 20. In particular, in this exemplary embodiment, the radiating ground plane slot 50 will be centered more or less at approximately one-fourth wavelength from the terminal end 20 of each microstrip transmission line segment. The length of the rectangular slot should probably be on the order of about one-half wavelength while its width dimension might be on the order of one-eighth wavelength or so as will be appreciated by those in the art. The coupling to/from r.f. radiation fields will occur via slot 50 due to the interruption of normal ground plane currents as should now be generally appreciated by those in the art. The alternate embodiment of FIG. 6B is substantially the same as that of FIG. 6A except that the radiating slots 50' have variable dimensions along their length so as to increase the bandwidth over which effective coupling to r.f. radiation fields can be expected to occur.

Figure 7:
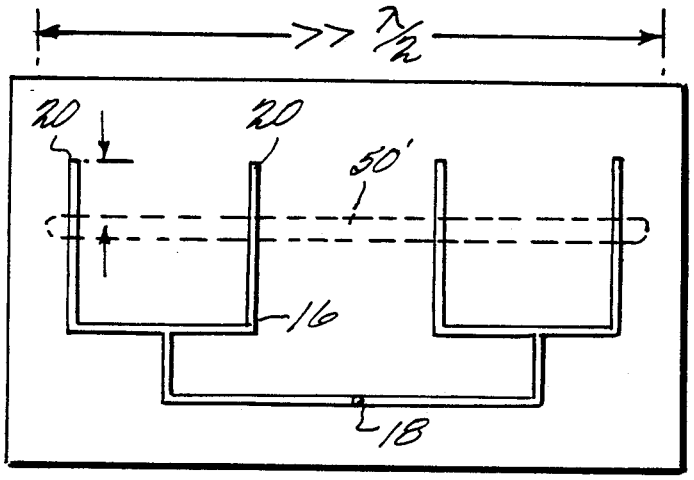
FIG. 7 depicts another alternate embodiment using an elongated radiating slot and multiple feedpoints.
Figure 8A:
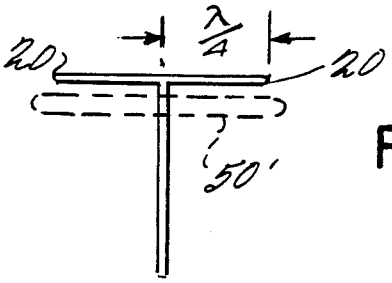
FIGS. 8*a*, 8*b* and 8*c* depict still further feeding and/or slot configurations.
Figure 8B:
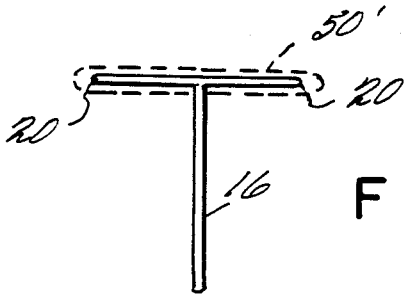
Figure 8C:
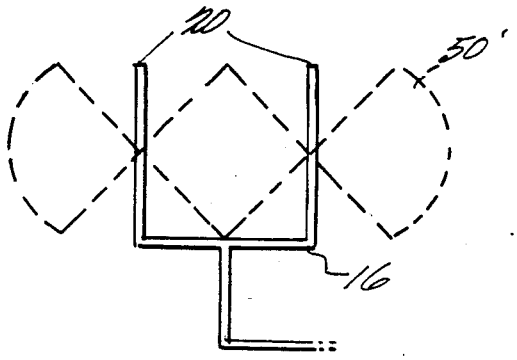

As depicted in FIG. 7, the slot 50' may be considerably extended in some embodiments. If so, it may be desirable to use plural microstrip feedlines spaced at intervals of no more than one wavelength, as should now be appreciated by those in the art. FIGS. 8*a* and 8*b* depict some of many possible feedline configurations while FIG. 8*c* depicts one of many possible slot configurations (e.g. to obtain even greater bandwidth). Those in the art will also appreciate that the completed antenna structure 10 may include controllable phase shifters (e.g. alternate microstrip transmission line path lengths selectable by selectively biased PIN diodes) signal enhancement amplifiers as well as other passive/active components typically associated with modern antenna systems.

While only a few exemplary embodiments have been described in detail, those skilled in the art will appreciate that many modifications and variations may be made in the exemplary embodiments while still retaining many of the novel advantages and features of this invention. Accordingly, all such variations and modifications are intended to be included within the scope of the appended claims.

What is claimed is:

1. An improved radio frequency antenna adapted for connection to a two conductor r.f. transmission line and comprising an array of individual radiator structures formed by two shaped printed circuit conductive structures registered with one another and cladded to respective opposite sides of a single dielectric sheet, said improvement comprising:

one of said conductive structures having shaped opening(s) therein;

the other one of said conductive structures having a microstrip transmission line leading from a common r.f. input/output terminal to non-shorted terminal end(s);

said shaped opening(s) being registered over said non-shorted terminal end(s) of said microstrip transmission line in the other conductive structure so as to cause each non-shorted end portion in registry with a corresponding said opening to become an individual radiator structure and to produce r.f. radiation to/from the antenna on both sides of said dielectric sheet and wherein said shaped conductive structures are each adapted for direct electrical connection to one respectively corresponding conductor of said two conductor r.f. transmission line.

2. An antenna structure comprising:

a dielectric sheet having top and bottom surfaces separated by a predetermined sheet thickness;

a shaped conductive microstrip feedline structure disposed on one of said surfaces and extending continuously from an r.f. feedpoint to at least one terminal end;

a shaped conductive reference surface disposed on the other one of said surfaces, said reference surface having an opening therein disposed in registry with each said terminal end; and a conductive reflective surface structure disposed to one side of said dielectric sheet.

3. An antenna structure as in claim 2 wherein the space between said conductive reflective surface and said conductive reference surface is substantially one fourth wavelength at the intended antenna operating frequency and which space is substantially filled by a dielectric structure which mechanically supports said dielectric sheet and the conductive structures disposed thereon.

4. An antenna structure as in claim 2 wherein each said opening, if upwardly projected, would entirely encompass its respective terminal end of the microstrip feedline structure.

5. An antenna structure as in claim 2 or 4 wherein said reference surface structure is shaped, at least in part, in complementary symmetry to the shape of each respective terminal end of the microstrip feedline structure at the site of each terminal end.

6. An antenna structure as in claim 5 wherein each said terminal end has a diverging width dimension.

7. An antenna structure as in claim 2 or 4 wherein each said terminal end has a diverging width dimension.

8. An antenna structure as in claim 2 wherein each said terminal end extends beyond the projected boundary of a respectively associated individual opening by approximately one-fourth wavelength at the intended antenna operating frequency.

9. An antenna structure as in claim 2 wherein there are plural terminal ends and plural respectively associated separate openings in the reference surface structure and wherein said feedline structure is of a corporate structure extending from said feedpoint to direct integrally formed connections with each of the terminal ends.

10. An antenna structure as in claim 2 wherein said shaped conductive structures are each integral structures photo-chemically etched from conductive layers cladded to the top and bottom surfaces of said dielectric sheet and wherein said conductive reflective surface structure comprises a second dielectric sheet affixed thereto.

11. A printed circuit antenna with direct feed, said antenna comprising:

a dielectric sheet having two surfaces separated by a predetermined sheet thickness of less than about one-tenth wavelength at the intended antenna operating frequency;

a shaped microstrip transmission line structure cladded to the two surfaces of the dielectric sheet, said transmission line structure including;

conductive microstrip lines having first predetermined edge boundaries disposed on a first side of the dielectric sheet and extending away from a single in/out feedpoint to at least one radiator feedpoint; and a contiguous conductive reference structure disposed on the second side of said dielectric sheet having second predetermined edge boundaries extending substantially beyond projected edge boundaries of said conductive microstrip lines so as to define therewith a non-radiating microstrip transmission line structure; and a monopole r.f. radiator having a predetermined shape and integrally formed with and connected to each said radiator feedpoint as an extended part of said conductive microstrip line structure extending beyond the projected edge boundaries of said conductive reference structure by approximately one-fourth wavelength at the intended antenna operating frequency.

12. A printed circuit antenna as in claim 11 further comprising:

a conductive reflector surface disposed behind said dielectric sheet.

13. A printed circuit antenna as in claim 11 or 12 wherein each said monopole r.f. radiator has a diverging width so as to increase its bandwidth of effective radiation.

14. A printed circuit antenna as in claim 11 or 12 wherein said conductive reference structure includes an integral conductive surface disposed adjacent each said radiator feedpoint which is shaped in complementary symmetry to the predetermined shape of its respectively associated monopole r.f. radiator.

15. A printed circuit antenna as in claim 13 wherein said conductive reference structure includes an integral conductive surface disposed adjacent each said radiator feedpoint which is shaped in complementary symmetry to the predetermined shape of its respectively associated monopole r.f. radiator.

16. A printed circuit antenna as in claim 11 or 12 wherein said conductive reference structure extends to cover said second side of the dielectric except for an aperture underlying each of said monopole r.f. radiators.

17. A printed circuit antenna as in claim 13 wherein said conductive reference structure extends to cover said second side of the dielectric except for an aperture underlying each of said monopole r.f. radiators.

18. A printed circuit antenna as in claim 14 wherein said conductive reference structure extends to cover said second side of the dielectric except for an aperture underlying each of said monopole r.f. radiators.

19. A printed circuit antenna as in claim 15 wherein said conductive reference structure extends to cover said second side of the dielectric except for an aperture underlying each of said monopole r.f. radiators.

20. A printed circuit antenna comprising:

a dielectric sheet having two surfaces separated by a predetermined sheet thickness of less than one-tenth wavelength at the intended antenna operating frequency;

shaped microstrip transmission line structure cladded to the two surfaces of the dielectric sheet, said transmission line structure including:

conductive microstrip lines of a first predetermined width disposed on a first side of the dielectric sheet and extending away from a single in/out feedpoint to at least one non-shorted terminal end, and a shaped conductive reference surface disposed on the second side of said dielectric sheet and extending thereover except for a radiating aperture formed therein in registry with each said non-shorted terminal end.

21. A printed circuit antenna as in claim 20 wherein each said aperture is approximately centered under a point on a conductive microstrip line disposed approximately one-fourth wavelength from its respective non-shorted terminal end.

22. A printed circuit antenna as in claim 21 wherein each said aperture is approximately rectangular in shape having a length approximately one-half wavelength at the intended antenna operating frequency and being disposed with said length dimension substantially transverse to the overlying conductive line.

23. A printed circuit antenna as in claim 22 wherein each said aperture has a width dimension on the order of one-eighth wavelength or less at the intended antenna operating frequency and wherein said width dimension varies along said length dimension to increase the bandwidth of effective radiation.

24. A printed circuit antenna as in claim 20, 21, 22 or 23 further comprising:

a conductive reflector surface disposed behind said dielectric sheet.

* * * * *